United States Patent [19]

Horn

[11] 4,428,087

[45] Jan. 31, 1984

[54] THERAPEUTICAL AIR MATTRESS

[76] Inventor: Friedrich Horn, Ludwigstrasse 7, 8950 Kaufbeuren, Fed. Rep. of Germany

[21] Appl. No.: 312,484

[22] Filed: Oct. 19, 1981

[30] Foreign Application Priority Data

Oct. 23, 1980 [DE] Fed. Rep. of Germany ..... 3039956

[51] Int. Cl.[3] ..... A47C 27/08

[52] U.S. Cl. ..... 5/449; 5/450/455

[58] Field of Search ..... 5/449–452, 5/455, 441, 435; 297/DIG. 3

[56] References Cited

U.S. PATENT DOCUMENTS

| | | | |
|---|---|---|---|
| 1,218,291 | 3/1917 | Meinecke | 5/450 |
| 2,582,439 | 1/1952 | Kavanagh | 5/455 |
| 2,731,652 | 1/1956 | Bishop | 297/DIG. 3 |
| 3,112,956 | 12/1963 | Schick et al. | 5/455 |
| 3,253,861 | 5/1966 | Howard | 297/DIG. 3 |

FOREIGN PATENT DOCUMENTS

| | | | |
|---|---|---|---|
| 616416 | 3/1961 | Canada | 5/455 |
| 159299 | 2/1921 | United Kingdom | 5/455 |

*Primary Examiner*—Alexander Grosz

*Attorney, Agent, or Firm*—Angelo Notaro; Steven H. Bazerman

[57] ABSTRACT

A therapeutic air mattress for attending patients consists of an inflatable hollow body provided with a pair of symmetrically arranged longitudinal air tubes which form an inflatable single chamber system and which almost adjoin one another in a head region and are spaced from one another in a body region where an intermediate chamber is provided in which an oblong resiliently deformable body is displaceably arranged, having a lower degree of deformation that the inflated pair of air tubes. Alternatively, the intermediate chamber also is inflatable, but independently of the pair of tubes, and in use is blown up to a greater extent than the pair of tubes.

Patients lying on the mattress can be set in rhythmical vibrations in order to attend on articular rheumatism and blockages of vertebrae and articulations.

5 Claims, 4 Drawing Figures

THERAPEUTICAL AIR MATTRESS

BACKGROUND OF THE INVENTION

According to the known art, patients who suffer from articular rheumatism, blockages of vertebrae and articulations or the like lie on a bed or table consisting of spaced bars or on a stuffed table when attended by massaging. The body of the patient remains substantially immovable when being massaged because of the immovability of the bed. As a result, if at all, only a small curing effect can be gained.

BRIEF SUMMARY OF THE INVENTION

One object of the present invention is the provision of a novel resilient base, for patients to be massaged which allows the patient's body to be subjected to vibrations. A further object of the invention is the provision of a mattress as a base for patients which has predetermined areas of different stiffness of different resiliency in order to hold the patient's body in a substantially predetermined position, but to allow certain parts of the patient's body to be oscillated during the massaging.

A further object of the invention is the provision of a mattress which provides a stabilized position of the patient, while nevertheless allowing parts of the patient's body to be oscillated especially gaining countermovements between the upper part of the body and the pelvic girdle when movements in one direction are periodically exerted on the body.

It is a further object of the invention to provide a novel, at least partly inflatable air mattress, which comprises a pair of tube-like air chambers communicating with one another, which air chambers having a small interspace in a head part of the mattress and which are spaced from one another in a body part of the mattress leaving a compartment therebetween which has a greater degree of stiffness than the remaining parts of the mattress formed by the inflated air chambers.

According to one important feature of the invention, the mattress is composed of a pair of inflatable tubes communicating with one another, the tubes are spaced from one another in a middle area of the mattress—as seen in the longitudinal direction of which—leaving a compartment therebetween in which a resilient solid body preferably consisting of synthetic foam material is arranged.

Therefore, according to this invention, a therapeutical mattress comprises a pair of inflated tubes of resilient material and a body arranged in the middle part of the mattress and limited by the pair of tubes, whereby the resiliency or deformability of the tubes is greater than that of the body.

Further objects, features and advantages will become apparent from the following detailed description, the claims and the drawings.

DESCRIPTION OF THE PREFERRED EMBODIMENTS

Figure 1:
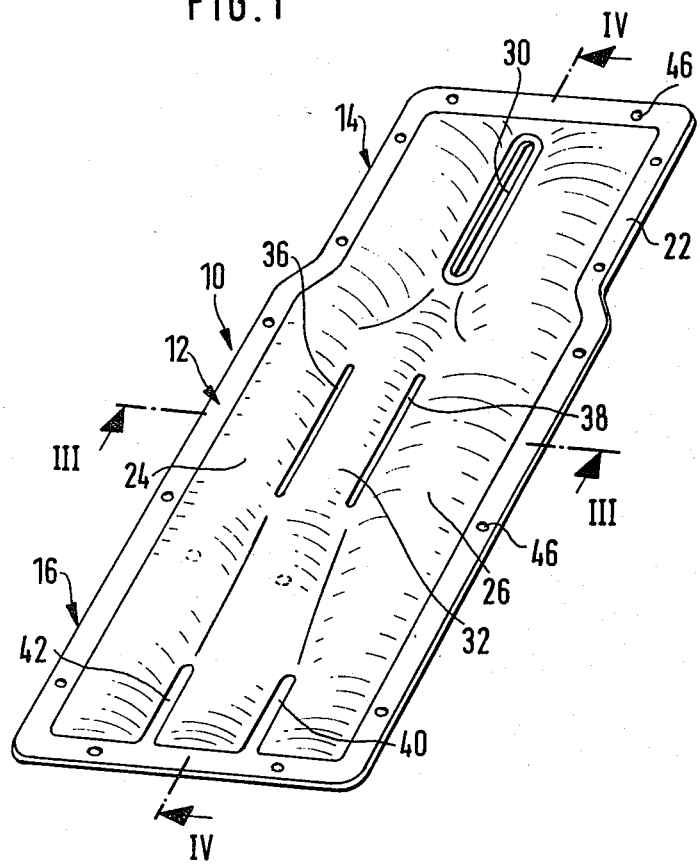
FIG. 1 is a perspective view of one embodiment of the new therapeutical mattress.
Figure 2:
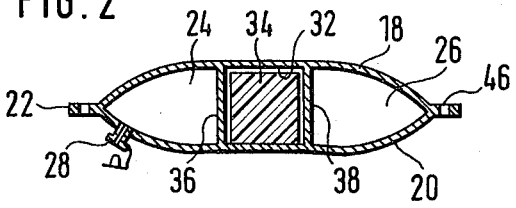
FIG. 2 is a cross-sectional view of the mattress taken along line III—III of FIG. 1.

A therapeutical mattress 10 has an oblong shape and consists of a pair of resilient walls 18, 20 of synthetic material tightly connected with one another by heat sealed or glued edge seams 22 and intermediate seams to form a pair of tube-like inflatable chambers 24, 26 which communicate with one another and therefore forming a single chamber air system which can be blown up through one valve provided in the lower wall 20 of the chamber 24 (FIG. 2). A removable closure 28 is provided for the valve. The chambers 24, 26 extend over the whole length of the mattress 10. The mattress shall be described as being composed of a head part 14, a body part 12 and a leg part 16.

In the head part 14, the pair of chambers 24, 26 lie adjacent on opposite sides of the longitudinal center plane and only a small interspace is formed therebetween. A longitudinal opening or slit 30 is provided in the pair of walls 18, 20 allowing the patient to breathe when lying in the belly position. The slit 30 is surrounded by airtight seams.

Figure 4:
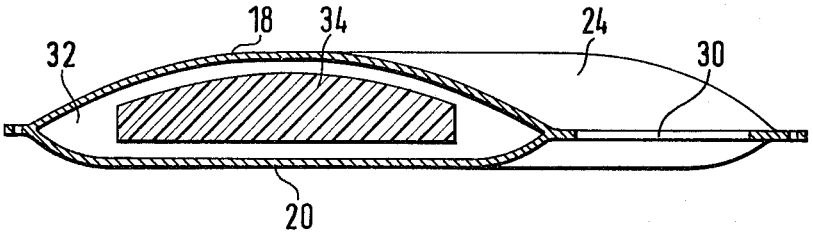
FIG. 4 is a longitudinal sectional view taken along line IV—IV of FIG. 1.

The body part 12 is of greater width than the head part 14 and therefore the pair of chambers 24,26 are spaced from one another leaving a tube-like compartment 32 therebetween. In the transition area between parts 14, 12 this compartment is wedgeshaped. The compartment 32 can communicate with the pair of inflatable chambers 24, 26 and in this case must be sealed against atmosphere. However, it is within the scope of this invention to seal the compartment 32 against the pair of chambers 24, 26 and to provide an opening in the lower wall 20 at the end of the leg part 16. A pair of intermediate longitudinal resilient walls 36,38 are connected with the pair of walls 18,20 respectively thereby separating the compartment 32 from the chambers 24,26. An oblong relatively stiff but resiliently deformable solid body 34 made of rubber or synthetic foam material is inserted in the compartment 32. The length of the body 34 is smaller than that of the compartment. Therefore, the body 34 can be longitudinally displaced for adaptation to the patient's stature. The height of the body 34 is greatest in the middle part and reduces gradually to both ends of the body. As seen in the longitudinal section of FIG. 4, the upper surface of the body is convexedly curved and the bottom surface is plane. The intermediate walls 36,38 have a geometrical similar shape respectively. The body 34 has a rectangular cross-section.

The tube-like chambers 24,26 are substantially of a constant height in the area of the body part 12. To the end of the head part 14 and to the end of the leg part 16 the chambers 24,26 are gradually flattened. A pair of seams 40, 42 connecting the pair of walls 18, 20 is provided at the end of the leg part 16, to divide the chambers from the end part of the compartment, thereby providing longitudinally extending recesses for the patient's legs.

The peripheral rim or seam 22 is provided with a plurality of openings 46 by means of which the mattress can be fastened on a table or on a frame.

Figure 3:
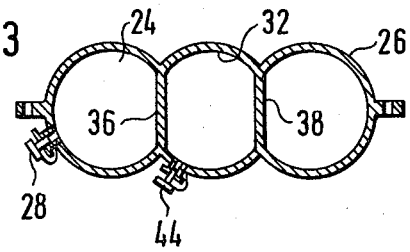
FIG. 3 is a cross-sectional view similar to FIG. 2 but showing a second embodiment.

FIG. 3 shows an alternative embodiment. The compartment 32 between the upper and lower walls and between the intermediate walls 36, 38 is sealed against the air-chambers 24, 26 and against the atmosphere and therefore forms a second inflatable chamber which can be blown-up through a valve provided with an closure 44.

From the foregoing it should be clear that in use the compartment 32 is blown up with a higher pressure than the pair of chambers 24, 26 in order to provide a center area of lower deformability of the mattress as compared with the surrounding areas thereof. It should be apparent that the body inserted in the compartment 32 instead of consisting of a foam material can alternatively be a tightly closed air-filled tube-like container provided that its deformability is less than that of the surrounding inflated air chambers.

I claim:

1. A therapeutical air mattress comprising: a pair of substantially rectangular oblong resilient walls connected with one another to define a pair of inflatable side chambers; a head part of said mattress in which said pair of side chambers are arranged with only a small interspace therebetween; a leg part; a body part of said mattress intermediate of and adjoining the head part and the leg part; the side chambers being spaced from one another in the body part by an oblong compartment provided between the side chambers which comprises a large interspace than the interspace in the head part; an oblong resiliently deformable body arranged within said oblong compartment and having a greater deformation resistance than the pair of side chambers, the deformable body being displaceably arranged within the compartment in the longitudinal direction of the mattress; and an opening extending through the walls provided in the longitudinal direction of the mattress between the side chambers in the head part of the mattress.

2. An air mattress as claimed in claim 1, wherein the side chambers have their maximum height in said body part of the mattress and the height dimensions gradually reduce to the end of the head part and to the opposite end of the leg part of the mattress.

3. An air mattress as claimed in claim 1, wherein the deformable body as seen in a vertical longitudinal sectional view has a convexedly shaped upper surface with the maximum height in the middle portion of the deformable body.

4. An air mattress as claimed in claim 1, wherein the deformable body comprises a synthetic foam material.

5. An air mattress as claimed in claim 1, wherein the deformable body comprises a fluid-filled resilient container.

* * * * *